US007793436B2

(12) United States Patent
Sink

(10) Patent No.: US 7,793,436 B2
(45) Date of Patent: Sep. 14, 2010

(54) FOOTWEAR WITH EXCHANGEABLE FASTENING SYSTEM

(76) Inventor: Jeffrey A. Sink, 154 Santiago Ave., Redwood City, CA (US) 94061

( * ) Notice: Subject to any disclaimer, the term of this patent is extended or adjusted under 35 U.S.C. 154(b) by 549 days.

(21) Appl. No.: 11/810,663

(22) Filed: Jun. 5, 2007

(65) Prior Publication Data

US 2007/0283594 A1 Dec. 13, 2007

Related U.S. Application Data

(60) Provisional application No. 60/812,319, filed on Jun. 9, 2006.

(51) Int. Cl.
*A43C 11/14* (2006.01)
*A43C 11/00* (2006.01)

(52) U.S. Cl. ..... 36/50.1; 36/11.5; 36/51; 24/300; 24/301

(58) Field of Classification Search ..... 36/50.1, 36/51, 52, 11.5; 24/300, 301
See application file for complete search history.

(56) References Cited

U.S. PATENT DOCUMENTS

| | | | | | |
|---|---|---|---|---|---|
| 317,654 | A * | 5/1885 | Kessel | 24/300 |
| 794,128 | A * | 7/1905 | Smith et al. | 267/74 |
| 1,211,127 | A * | 1/1917 | Fox | 36/51 |
| 1,933,467 | A * | 10/1933 | Yartyan | 36/50.1 |
| 2,525,269 | A * | 10/1950 | Olson | 36/50.1 |
| 3,533,172 | A * | 10/1970 | Jones | 36/51 |
| 4,559,678 | A * | 12/1985 | Birkenstock | 24/323 |
| 4,972,613 | A * | 11/1990 | Loveder | 36/105 |
| 5,295,315 | A * | 3/1994 | Osawa et al. | 36/50.1 |
| 5,313,669 | A * | 5/1994 | Rasdell et al. | 2/323 |
| 5,412,852 | A * | 5/1995 | Smaragdas | 24/713.6 |
| 5,465,506 | A * | 11/1995 | Matis et al. | 36/11.5 |
| 5,526,585 | A * | 6/1996 | Brown et al. | 36/50.1 |
| 5,640,785 | A | 6/1997 | Egelja | 36/50.1 |
| 5,692,320 | A | 12/1997 | Nichols | 36/51 |
| 5,794,360 | A * | 8/1998 | Bell et al. | 36/7.6 |
| 5,933,985 | A | 8/1999 | James | 36/50.1 |
| 6,256,906 | B1 * | 7/2001 | Matis et al. | 36/11.5 |
| 6,543,097 | B2 * | 4/2003 | Burt et al. | 24/170 |
| 7,121,020 | B1 * | 10/2006 | Bathum | 36/102 |
| 7,146,751 | B2 * | 12/2006 | Seamans | 36/50.1 |
| 7,533,478 | B2 * | 5/2009 | Bird et al. | 36/50.1 |
| 2006/0254089 | A1 * | 11/2006 | Frydlewski | 36/50.1 |
| 2007/0277398 | A1 * | 12/2007 | Davis et al. | 36/50.1 |

* cited by examiner

*Primary Examiner*—Jila M Mohandesi

(57) ABSTRACT

A footwear member includes a set of stretchable fastening members that allow a user to select and attach those fastening members that provide the best fit. Each selected fastening member is attached at its opposite ends to connection structures that are paired. For example, the paired connection structures may be two posts that have grooves in order to properly seat and retain the ends of the fastening members. Two acceptable materials for forming the fastening members are rubber and urethane. The fastening members may be referred to as "bungee cords." There are at least two different lengths of fastening members in order to provide selection on the basis of the shape or size of a user's foot. Selection of the proper "bungee cord" also applies to an attachment at the Achilles area of the wearer's foot.

16 Claims, 3 Drawing Sheets

FOOTWEAR WITH EXCHANGEABLE FASTENING SYSTEM

CROSS REFERENCE TO RELATED APPLICATION

This application claims priority from provisional application No. 60/812,319, filed Jun. 9, 2006.

TECHNICAL FIELD

The present invention relates to footwear, such as sandals, and in particular footwear constructed with a fastening system that can be adjusted for feet of various shapes without requiring buckles or similar approaches for securing differently shaped feet.

BACKGROUND ART

The invention pertains to footwear and in particular to a closure system for sport sandals. Sport sandals have become popular in recent years to enable athletic activities to be preformed while wearing sandals. Many designs have been introduced over the years. Due to the different shapes and sizes of feet, most sandals have some type of a strapping system to accommodate the different shapes. The most popular strapping system for sport sandals uses a strap configuration with hook-and-loop materials as a means for adjusting the sandal to alternative shapes. Other designs have used plastic buckle connectors that are adjusted by simply changing the length of the strap.

One of the problems with current closure systems in sandals is that once they are adjusted and closed, there is no movement in the systems to accommodate the bending or flexing of the foot when walking or while doing athletic activities. Traditionally, footwear such as sandals has two or three separate straps, each carrying a fastener. This enables the sandal to be securely fastened to the foot when worn, while allowing easy removal when desired.

It is an object of the invention to provide a fastening system that allows the user to customize the fit needed for certain foot shapes. It is another object of the present invention to allow a closure system to provide increased support to the foot, while allowing movement of the closure system as the foot flexes and bends during walking or athletic activities.

SUMMARY OF THE INVENTION

A footwear member in accordance with the invention comprises a foot-receiving portion having a configuration for wear on a human foot, a set of fastening members, and a number of paired connection structures. Each fastening member is formed of a material which stretches in order to secure the foot-receiving portion to the foot. When in a relaxed condition, there are at least two different lengths of fastening members within the set. Thus, the selection of proper fastening members may be based upon the size and shape of the wearer's foot. For each paired connection structure, a first end of a fastening member is connected to one connection structure, while the second end of the fastening member is releasably attached to the other connection structure of the pair.

In one embodiment of the invention, the footwear member uses multiple woven non-stretch straps to properly secure the footwear around the forefoot and ankle areas. Attached to each woven non-stretch strap is a molded rigid "O-ring" holder comprised of a slot at one end to accept the woven non-stretch strap. The woven non-stretch strap slides through the slot and is folded rearwardly, so that the O-ring holder is secured to the strap. At the other end of the O-ring holder is a post that extends upwardly, with a configuration that includes a recessed grooved area surrounding the post. In this embodiment, the grooved post functions as one of the connection structures.

The fastening members may be referred to as molded flexible "bungee cords" which have an "O-ring" design at one end and a half O-ring (U shape) design at the other end. Extending from the half O-ring end is a flat extension tab with small indentations which are used as a handle for the person as the bungee cord is pulled for attachment to a rigid molded securing post, which is the other connection structure within the pair.

The O-ring end of the flexible bungee cord is pressed onto the grooved post on the rigid holder attached to the woven non-stretch strap. After the O-ring of the bungee cord is placed onto the grooved post, it is secure from accidental removal, but can be manually peeled off if necessary in order to change the length of the flexible bungee cord so as to accommodate differently shaped fit. Thus, this end of the bungee cord (flexible member) is more securely coupled than the end having the half O-ring shape. Attached to the sole of the foot-receiving portion is a similar molded rigid holder with a post extending outwardly and a groove surrounding the post. After the user places a foot into the foot-receiving portion, the user is able to pull the woven non-stretch strap and the bungee cord using the tab, so as to secure the half O-ring end over the rigid post attached to the sole of the foot-receiving portion.

By allowing a user to select a certain length of stretchable fastening member for a particular pair of connection structures, the user can adjust the tension of the securement of the footwear member to the foot, so as to accommodate different shapes and sizes of feet. Preferably, the number of fastening members (bungee cords) exceeds the number of paired connection structures, allowing a wearer to select lengths that are most accommodating with respect to that user.

BRIEF DESCRIPTION OF THE DRAWINGS

The accompanying drawings, which are incorporated in and form a part of this specification, illustrate embodiments of the invention and together with the description, serve to explain the principle of the invention.

DETAILED DESCRIPTION OF THE PREFERRED EMBODIMENTS

Referring now to the accompanying drawings, reference will be made in detail to the preferred embodiments of the invention. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention.

As will be described, in one preferred embodiment, the present invention provides an adjustable fastening system to secure the foot in both sandals and other types of footwear. The fastening system comprises a non-stretch band, which may be a seat belt material, secured to a molded rigid unit using a grooved post extending upwardly. Placed over the grooved post is a molded flexible "bungee cord" having an O-ring shape on one end to surround the grooved post. Extending from the O-ring shape are bars on both sides which form a U shape at the opposite ends of the O-ring. Attached to the side of a shoe or sandal are molded rigid units with a similar grooved post extending outwardly. The "bungee cord" is pulled over the foot, placing the U-shaped end over the grooved post to secure the foot in place.

Figure 1:
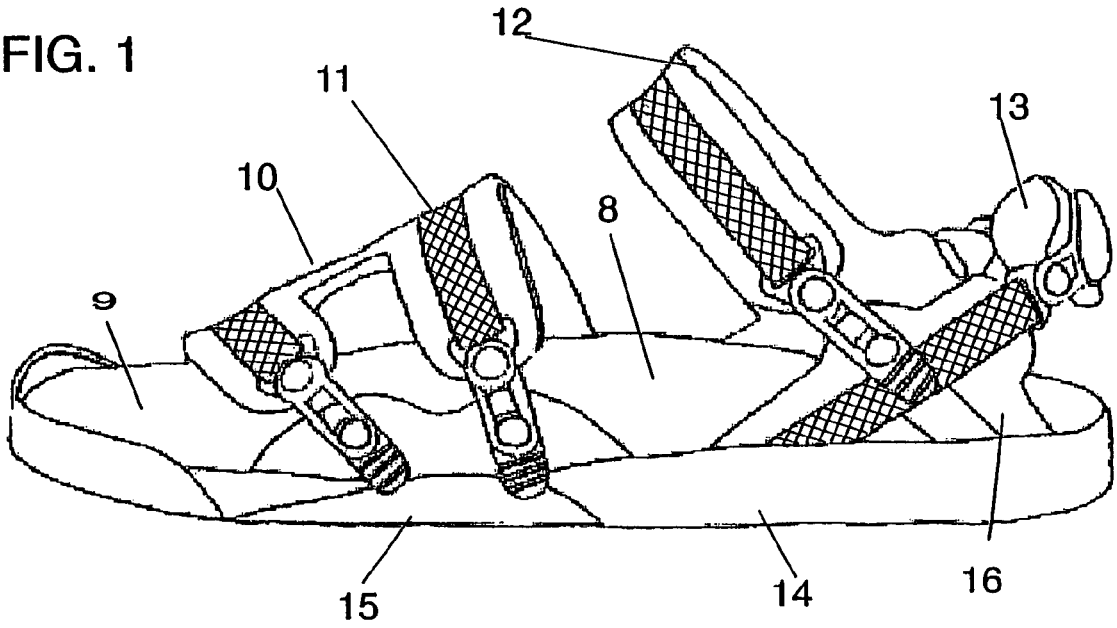
FIG. 1 is a side elevation view of a sandal shown in accordance with one embodiment of the present invention.
Figure 2:
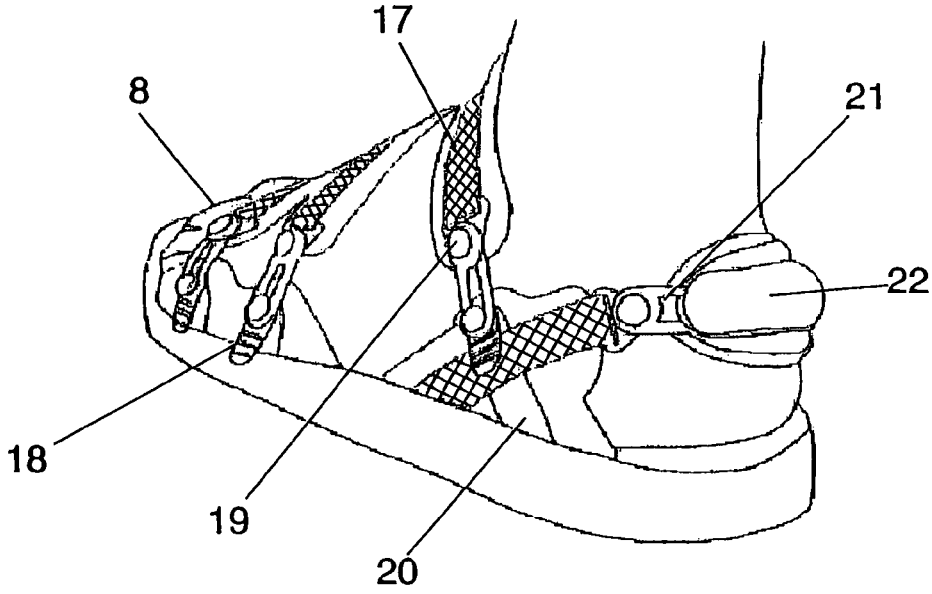
FIG. 2 is a rear elevation view of a sandal shown in accordance with one embodiment of the present invention.
Figure 5A:
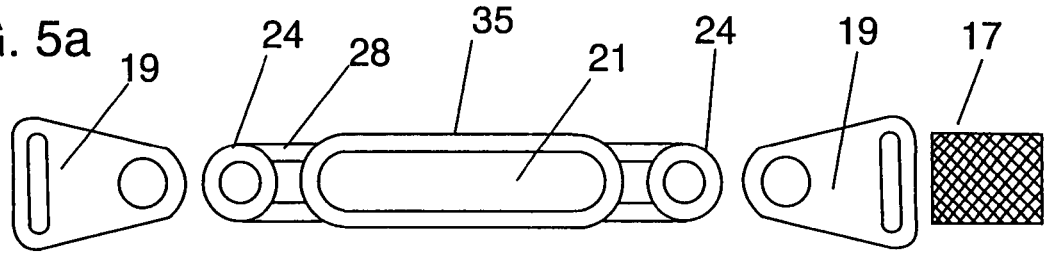
FIG. 5*a* is an elevation view of the individual rear parts shown in accordance with one embodiment of the present invention.
Figure 6A:
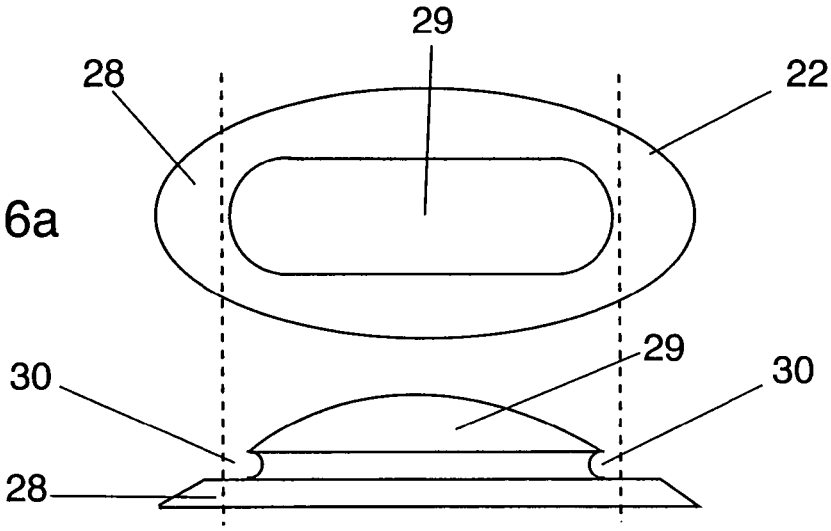
FIG. 6*a* are side and top views of a rear Achilles pad shown in accordance with one embodiment of the present invention.

FIG. 1 is a side view of a sandal 8 according to the present invention. Sandal 8 is made up of a foot bed 9, which is cemented to a mid-sole 14. Prior to cementing foot bed 9 to mid-sole 14, a forefoot unit 10, which can made from a molded foam, such as EVA, or stitched fabric, is cemented to a sidewall of foot bed 9. Also cemented to foot bed 9 are a medial rear unit 12 and a lateral rear unit 16. These units can be made from materials that are similar to the materials of forefoot unit 10. Attached to units 10, 12, and 16 are assembled straps 11 which consist of a non-stretch seat belt material 17 and a molded rigid O-ring holder 19, as shown in FIG. 2. The rear Achilles area 13 has a molded foam or stitched fabric unit 22, as shown in FIG. 6*a*, which is secured in place by a flexible molded "bungee cord" unit 21, as shown in FIG. 5*a*. Attached to mid-sole 14 is an outsole 15 to provide traction and durability.

FIG. 2 shows a rear view of the sandal 8 shown in FIG. 1. Sandal 8 includes non-stretch straps of seat belt material ("seat belt straps") 17, attached to O-ring holders 19 to secure bungee cords 18. Once bungee cords 18 are secured to O-ring holders 19, the assembled units are pulled over the foot and attached to molded rigid securing units 20. Rear unit 13 is made of a flexible "bungee cord" unit 21 surrounding the foam or stitched unit 22. Once flexible "bungee cord" unit 21 is placed around the extended area of rear unit 22, it is attached to molded rigid O-ring holders 19, which are attached to seat belt straps 17 on both the lateral and medial sides of sandal 8.

Figure 3A:
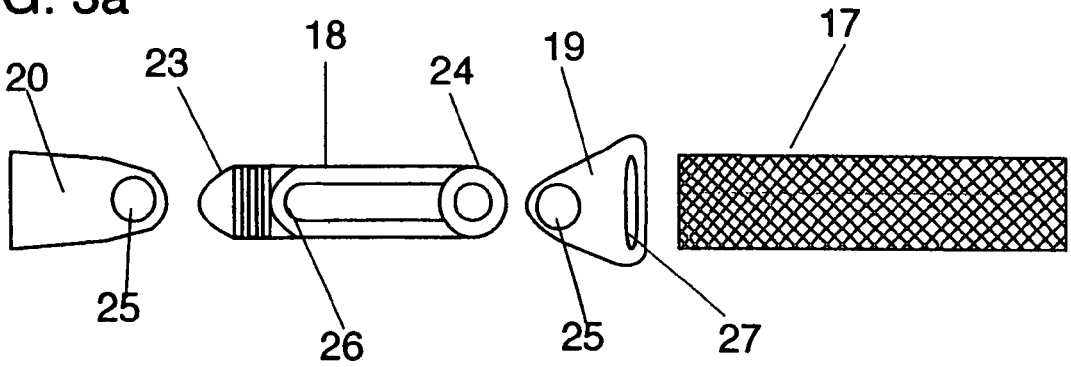
FIG. 3*a* is an elevation view of the individual parts shown in accordance with one embodiment of the present invention.

FIG. 3*a* is a top view of the individual parts that comprise an assembled strap unit 11 as shown in FIG. 1. Non-stretch seat belt strap 17 is attached to O-ring holder 19 by placing one end of seat belt strap 17 though slot 27 in molded rigid O-ring holder 19. After seat belt strap 17 is placed through slot 27, it is folded back and stitched together to secure molded rigid O-ring holder 19 in place. On one end of O-ring holder 19 is a grooved post 25 to accept a flexible O-ring 24 on "bungee cord" 18. "Bungee cord" 18 is made from a flexible material such as rubber or urethane, so that it can stretch slightly as needed, but provides force to secure the sandal to a human foot. One end of "bungee cord" 18 has an O-ring shape which secures onto post 25 of rigid molded O-ring holder 19 by simply pressing the O-ring side over post 25. Extending from O-ring 24 is an elongated "U" shape 26 which has a tab 23 used to grip "bungee cord" 18 as the user pulls the entire strap unit 11 (FIG. 3*b*) over the foot to secure onto molded rigid securing unit 20. The molded rigid securing unit 20 is made from a rigid material such as nylon, PVC, or some other plastic. Molded rigid securing unit 20 has the same grooved post 25 configuration as on molded rigid O-ring holder 19.

Figure 3B:
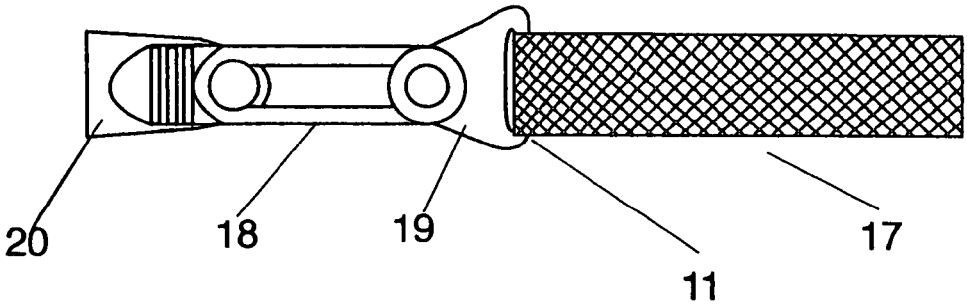
FIG. 3*b* is an elevation view of the assembled parts shown in accordance with one embodiment of the present invention.

FIG. 3*b* is a top view of an assembled strap unit 11 consisting of seat belt strap 17, molded rigid O-ring holder 19, "bungee cord" 18, and rigid molded securing unit 20. When the entire unit 11 is connected by the user, there is a slight amount of tension, so that the entire unit 11 will stay secure on the foot.

Figure 4A:
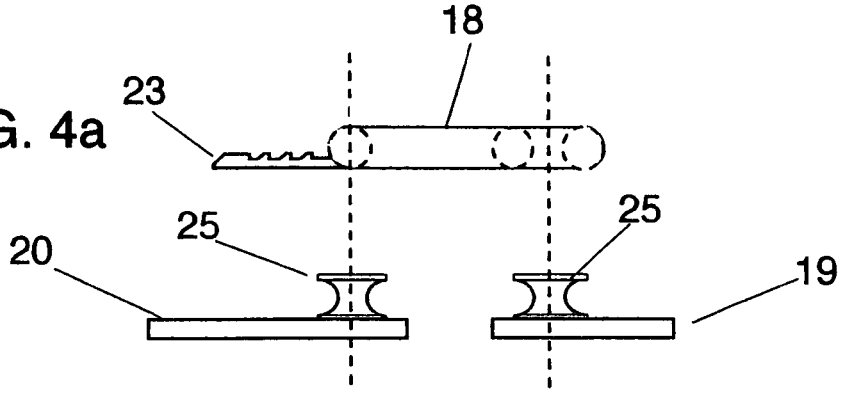
FIG. 4*a* is a side view of the individual parts shown in accordance with one embodiment of the present invention.

FIG. 4*a* is a side cross section view of "bungee cord" 18, molded rigid O-ring holder 19, and molded rigid securing unit 20. "Bungee cord" 18 shows one side having an O-ring shape in dotted lines, and the opposite side is a similar round shape. The U-shaped end has an extension 23 which has multiple slots to act as teeth to allow a good grip when pulling the unit over the foot and attaching it to molded rigid securing unit 20.

Figure 4B:
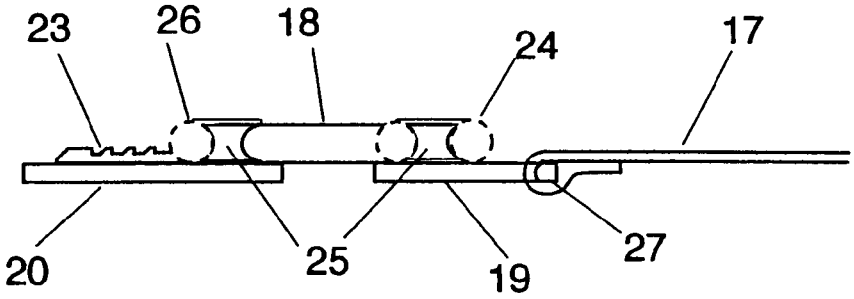
FIG. 4*b* is a side view of the assembled parts shown in accordance with one embodiment of the present invention.

FIG. 4*b* is a side cross section view of an assembled strap unit according to the present invention. The assembled strap unit consists of a non-stretch seat belt strap 17 which is attached to a molded rigid O-ring holder 19 by placing strap 17 through slot 27, which is then folded back and stitched to secure the molded rigid O-ring holder to strap 17. Rigid molded O-ring holder 19 has a grooved post 25 extending upwardly to allow the flexible molded O-ring to surround post 25 and secure "bungee cord" 18 onto the rigid molded O-ring holder 19. "Bungee cord" 18 can be easily peeled from the rigid molded O-ring holder 19, so as to allow the user to change the length of "bungee cord" 18 to accommodate feet of different shapes and sizes. Preferably, the "bungee cords" are packaged in sets, so that the wearer can select the best fits. Once the O-ring side of the "bungee cord" 18 is secured over post 25 of rigid molded O-ring holder 19, the opposite U-shaped side 26 is pulled using tab 23 to secure "bungee cord" 18 over the grooved post 25 on the rigid molded securing unit 20.

FIG. 5*a* is a top view of the rear flexible molded "bungee cord" 35 that attaches at the Achilles area of a user's foot. The rear flexible molded "bungee cord" 35 has O-rings 24 on both ends. Extending from O-rings 24 are bars 28 on each side of "O" ring 24 which connect the O-rings to inner area 21. Inner area 21 of "bungee cord" 35 is an oval with U-shaped ends. Both O-rings 24 on the ends of "bungee cord" 35 can be press-fit onto rigid molded O-ring holders 19 to secure "bungee cord" 35 onto the rear section of sandal 8, as shown in FIG. 1. Both molded rigid O-ring holders are attached to non-stretch seat belt straps 17.

Figure 5B:
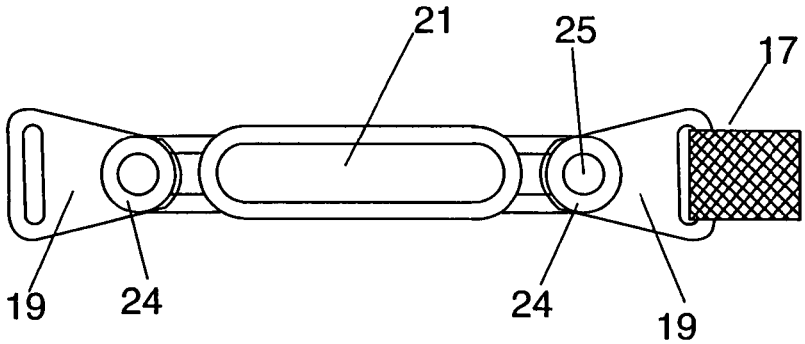
FIG. 5*b* is an elevation view of the assembled rear parts shown in accordance with one embodiment of the present invention.

FIG. 5*b* is a top view of an assembled rear flexible molded "bungee cord" 35 of FIG. 5*a* attached on either end to rigid molded O-ring holders 19, which are attached to non-stretch seat belt straps 17. Assembly of the rear flexible unit is made by pressing the O-ring 24 sides of the "bungee cord" over posts 25 of molded rigid O-ring holders 19.

FIG. 6*a* are top and side views of the rear Achilles pad 22 that is shown in FIG. 2. Rear Achilles pad 22 has a bottom area 28 and a top area 29. Around the entire base of top area 29 as it meets bottom area 28 is a groove 30. Groove 30 allows the flexible "bungee cord" 35 as show in FIG. 5*a* to fit into groove 30 to secure the rear Achilles pad 22 to the rear "bungee cord"

35. "Bungee cord" 35 can be removed from rear Achilles pad 22 and changed to accommodate differently shaped feet.

Figure 6B:
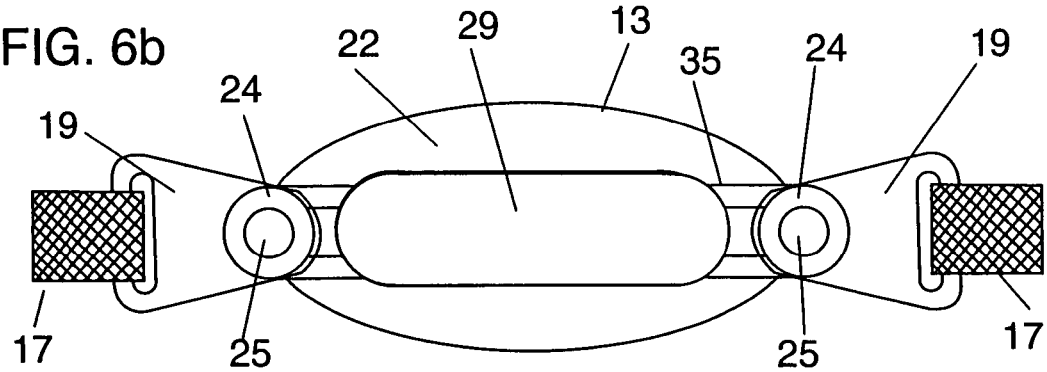
FIG. 6*b* is an elevation view of an assembled rear Achilles unit shown in accordance with one embodiment of the present invention.

FIG. 6*b* is a top elevation view of the assembled rear unit 13 as shown in FIG. 1. The rear unit 13 includes the flexible "bungee cord" 35, which fits into groove 30 on rear Achilles pad 22 to secure the two together. On flexible "bungee cord," O-rings 24 on both ends are press-fit onto the posts 25 of the molded rigid O-ring holders 19 to lock into place. Secured to the rigid molded O-ring holder 19 are non-stretch seat belt straps 17.

What is claimed is:

1. A footwear member comprising:

a foot-receiving portion configured to be worn on a human foot;

a set of fastening members formed of a material selected to enable said fastening members to stretch in order to secure said foot-receiving portion to said human foot, said fastening members of said set having at least two different lengths when in a relaxed condition, each said fastening member having a first end and a second end; and a plurality of paired connection structures, each paired connection structure being first and second connection structures configured for attachment of one of said fastening members for securing said foot-receiving portion to said human foot, said fastening members in said set being greater in number than said paired connection structures;

wherein attachment of a selected said fastening member to a particular said paired connection structure includes structurally different couplings to said first and second connection structures, respectively, said first end being coupled to said first connection structure in a releasable but more secure manner as compared to coupling of said second end to said second connection structure, wherein said couplings to said first and second connection structures are limited to a single seating position of said first end to first connection structure and a single seating position of said second end to said second connection structure, such that adjustment of said selected fastening member with respect to said human foot is based only on said material selected to enable stretch, said material enabling bungee cord stretching.

2. The footwear member of claim 1 wherein said first and second ends have different configurations, each said first end having an O-ring shape and each said second end having a U-shape, said first ends thereby being more securely coupled to said first connection structures than said second ends are connected to said second connection structures.

3. The footwear member of claim 2 wherein said second ends are slidably fit to said second connection structures, while said first ends are shaped to fit about posts by conforming to a shape of said posts, said first ends being flexible such that removal from said posts is enabled, each said second end including an extension tab for use as a handle as said second end is moved into and out of attachment to a second post upon sliding said second end perpendicular to an axis of said second post.

4. The footwear member of claim 2 wherein each of said first and second connection structures includes a grooved post.

5. The footwear member of claim 1 wherein said foot-receiving portion defines a sandal having non-stretch straps, each said strap being operatively associated with one of said paired connection structures.

6. The footwear member of claim 5 further comprising a stretchable member attached at a rearward region of said foot-receiving portion to contact an Achilles area of said human foot.

7. The footwear member of claim 6 wherein said stretchable member is releasably attached to said foot-receiving portion to enable replacement.

8. The footwear member of claim 1 wherein each said paired connection structure includes a pair of O-ring holders configured to couple to said first and second ends of one of said fastening members.

9. The footwear member of claim 1 wherein said foot-receiving portion defines a shoe, said fastening members being attached to said paired connection structures such that said first ends are coupled to a shoe portion that passes over the top of said human foot while said second ends are coupled to a sole portion.

10. A fastening system for securing a footwear member to a human foot comprising:

a plurality of pairs of operationally associated connection structures, said connection structures being fixed to a foot-receiving portion of said footwear and being positioned such that force which is applied to pressure said operatively associated connection structures of any one of said pairs operates to secure said footwear; and a set of fastening members formed of a material that enables bungee cord stretching, said fastening members having relaxed conditions and stretched conditions, said fastening members having a plurality of different lengths when in said relaxed conditions, each said fastening member having first and second ends configured to attach to said connection structures of one of said pairs in a releasable manner, said first ends having a shape different than a shape of said second ends, said shape of said first ends being such that said first ends require a press fit to said connection structures, while said second ends have a U-shape that enables said second ends to slide onto said connection structures after said fastening members are stretched past said connection structures and then allowed to retract so as to slide onto said connection structures.

11. The fastening system of claim 10 wherein each said fastening member is formed of rubber or urethane.

12. The fastening system of claim 10 wherein each said connection structure is a post.

13. The fastening system of claim 10 wherein the number of said fastening members in said set exceeds the number of said pairs of connection structures.

14. A fastening system for securing a footwear member to a human foot comprising:

a plurality of pairs of operationally associated connection structures, said connection structures being fixed to a foot-receiving portion of said footwear and being positioned such that force which is applied to pressure said operatively associated connection structures of any one of said pairs operates to secure said footwear; and a set of fastening members having relaxed conditions and stretched conditions, said fastening members having a plurality of different lengths when in said relaxed conditions, each said fastening member having first and second ends configured to attach to said connection structures of one of said pairs in a releasable manner, said first ends having a shape different than a shape of said second ends, said shape of said first ends being such that said first ends require a press fit to said connection structures, while said second ends have a shape that enables said second ends to slide onto said connection structures;

wherein each said connection structure is a post.

15. The fastening system of claim 14 wherein each said post is grooved and wherein said first ends of said fastening members are O-shaped and dimensioned to fit about one of said posts.

16. The fastening system of claim 15 wherein said second ends of said fastening members are U-shaped to enable said second ends to slide onto said posts.

* * * * *